US005980333A

United States Patent [19]

Nakamura et al.

[11] Patent Number: 5,980,333

[45] Date of Patent: Nov. 9, 1999

[54] CONNECTOR MEMBERS

[75] Inventors: Hideto Nakamura; Hisashi Konoya, both of Yokkaichi, Japan

[73] Assignee: Sumitomo Wiring Systems, Ltd., Mie, Japan

[21] Appl. No.: 08/999,234

[22] Filed: Dec. 29, 1997

[30] Foreign Application Priority Data

Dec. 27, 1996 [JP] Japan ..... 8-351297

[51] Int. Cl.[6] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 5,460,550 | 10/1995 | Okayasu et al. | 439/752 |
| 5,501,619 | 3/1996 | Sakatani et al. | 439/752 |
| 5,651,703 | 7/1997 | Sasai | 439/752 |
| 5,669,791 | 9/1997 | Endo et al. | 439/752 |

FOREIGN PATENT DOCUMENTS

| | | |
|---|---|---|
| 8-287992 | 11/1996 | Japan . |
| 9-17486 | 1/1997 | Japan . |

*Primary Examiner*—Gary F. Paumen
*Attorney, Agent, or Firm*—Oliff & Berridge, PLC

[57] ABSTRACT

A connector member for use in connecting electrical wiring is received by another connector part and has a housing body for receiving metal wiring terminals. In a recess of the housing having opposed side walls, there is a resilient locking arm having a head portion. The locking arm locks with another connector part and there are gaps formed between the head portion and the side walls. A terminal retainer is mounted on the housing for locking the metal terminals in place. To prevent a wire or other foreign body being trapped in the gaps between the arm and the side walls, the terminal retainer has a pair of gap blocking portions which, in its locked position, lie on opposite sides of the head portion of the locking arm so as to partially block these gaps.

8 Claims, 9 Drawing Sheets

CONNECTOR MEMBERS

BACKGROUND OF THE INVENTION

1. Field of Invention

This invention relates to connectors for connecting electrical wiring, and in particular, to a connector member which is adapted to house metal terminals which are to be connected to terminals in another connector member. The connector member has at least one terminal retainer to lock the terminals in position, and a locking arm which locks the connector member to another connector part.

2. Description of Related Art

A connector member of this type equipped with terminal retainers is shown in JP-A-8-287992. The connector is composed of a connector housing body and two terminal retainers. On one face of the housing body, there is a resilient locking arm for locking the connector member in position in a complementary connector part which is in the form of a housing for receiving the connector member. This locking arm is partly located in a recess which is formed at the central part of the upper face of the housing body, and is designed not to protrude from the housing body more than required.

Gaps are present between the locking arm and the side faces of the recess. These gaps permit a smooth fit with the receiving connector part. However, these gaps allow the possibility of the invasion of foreign articles, particularly the trapping of a wire during assembly of the connector. There is also a risk of having the locking arm lifted if a wire is trapped beneath it, which would prevent its proper locking function, and result in an incorrect assembly of the connector.

SUMMARY OF THE INVENTION

An object of the present invention is to provide a connector member in which the risk of trapping a foreign article, such as a wire or the like, in gaps between a locking arm and a connector housing, is reduced or avoided.

According to the invention, there is provided a connector member for use in connecting electrical wiring. The connector member has a housing body having a rear end and a front end, a first face extending from the rear end to the front end, and a plurality of passages for receiving metal wiring terminals extending from the rear end towards the front end. There is a recess in the first face having opposing side walls. A resilient locking arm has a first end mounted on the housing body, an arm portion extending in cantilever manner from the first end, and a head portion which is remote from the first end and projects above the arm portion in the direction away from the base of the recess. The locking arm is adapted to engage and lock with another connector part, and is at least partly located in the recess between the opposing side walls. Gaps are formed between said head portion and the side walls. A terminal retainer is mounted on the housing body so as to extend across the first face, and is found on the housing body in a position in which the metal terminals, which have been inserted in the passages of the housing body, are locked in place. The terminal retainer has at its rearward end a pair of gap blocking portions which, in its locking position, lie on opposite sides of the head portion of the locking arm so as to partially block the gaps between the head portion of the locking arm and the side walls of the recess.

With the structure of the invention, since the gap blocking portions of the retainer block the gaps between the locking arm and the side walls of the recess when the retainer is installed on the connector housing body, the risk of trapping of foreign articles, such as a wire or the like, can be prevented or reduced. The gap blocking portions may overlie the gaps between the locking arm, particularly the head portion of the locking arm, or may be at least partially located in the gaps.

In one preferred embodiment the two gap blocking portions are mutually connected by a connection portion beneath the locking arm so that the strength of central part of the terminal retainer is improved. This is effective to prevent bending or deformation of the retainer at the time of molding or use.

BRIEF DESCRIPTION OF THE DRAWINGS

Embodiments of the invention will now be described by way of non-limiting examples with reference to the accompanying drawings, in which.

DETAILED DESCRIPTION OF PREFERRED EMBODIMENTS

Figure 1:
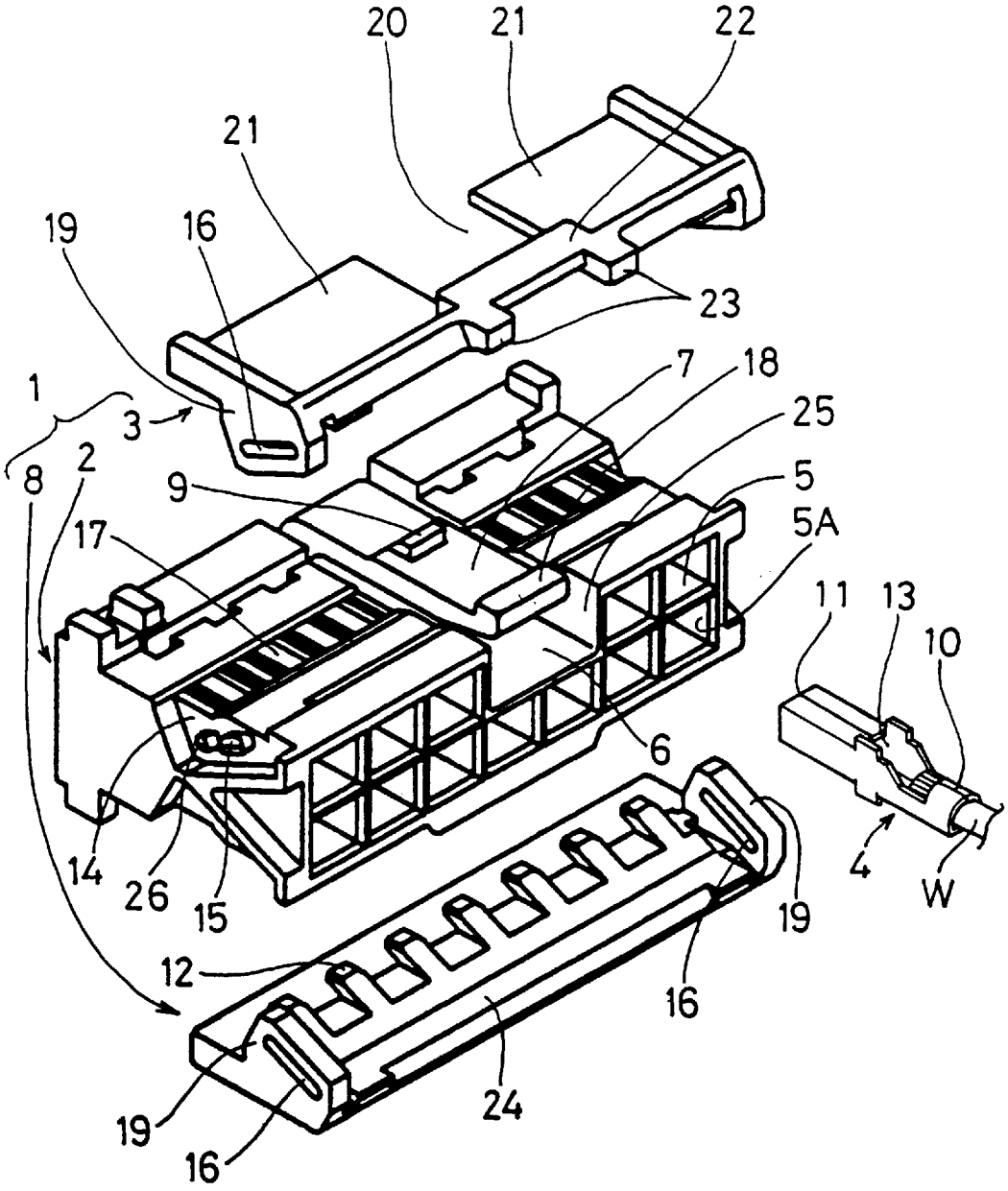
FIG. 1 is a perspective view of the parts of a first embodiment of the invention before the installation of the retainers on the connector housing body.

The first embodiment of the present invention is described referring to FIGS. 1–4. The connector member 1 (female connector) is intended for use in the manner similar to that shown in JP-A-8-287992 discussed above, for insertion into a receiving housing part. It comprises the connector housing body 2, inside of which the metal terminal fittings are located and outside of which two terminal retainers 3, 8 are installed. The connector housing body 2 is integratedly molded of a suitable synthetic resin material, and has terminal-receiving passages 5 in two rows at the top and the bottom, defined by walls 5A. The passages 5 are open at the back or rear face of the connector housing body 2, as seen in FIG. 1.

Figure 2:
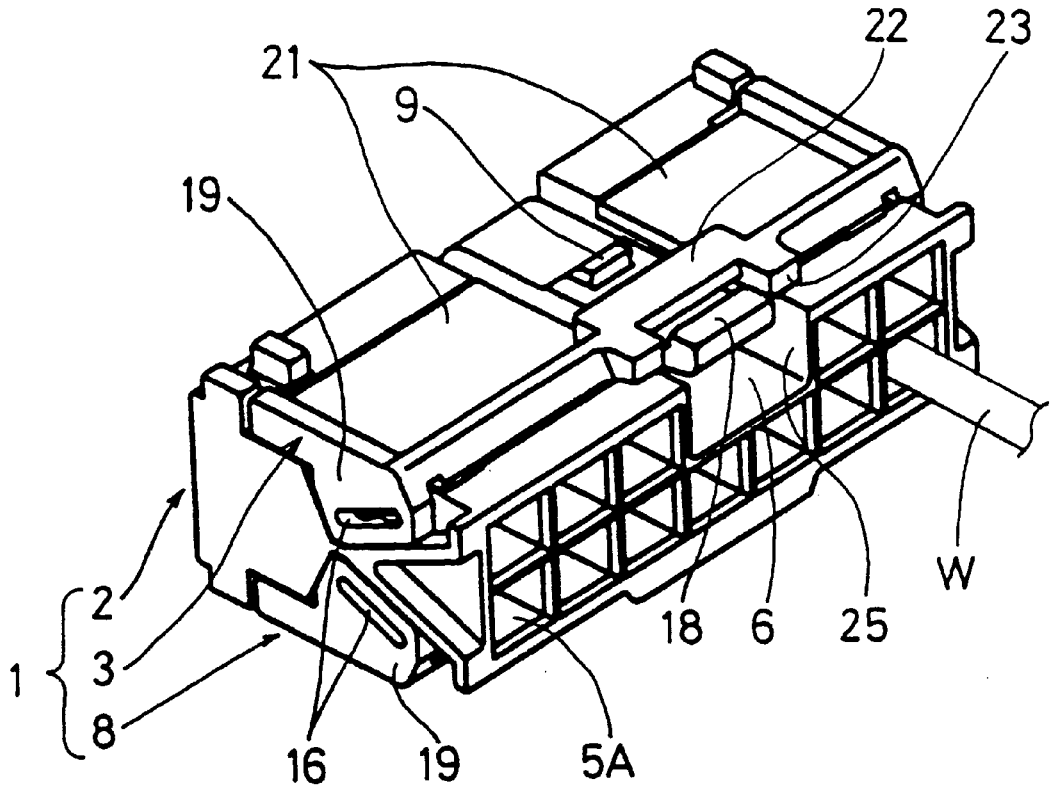
FIG. 2 is a perspective view of the connector of FIG. 1 after the installation of the retainers on the connector housing body.
Figure 4:
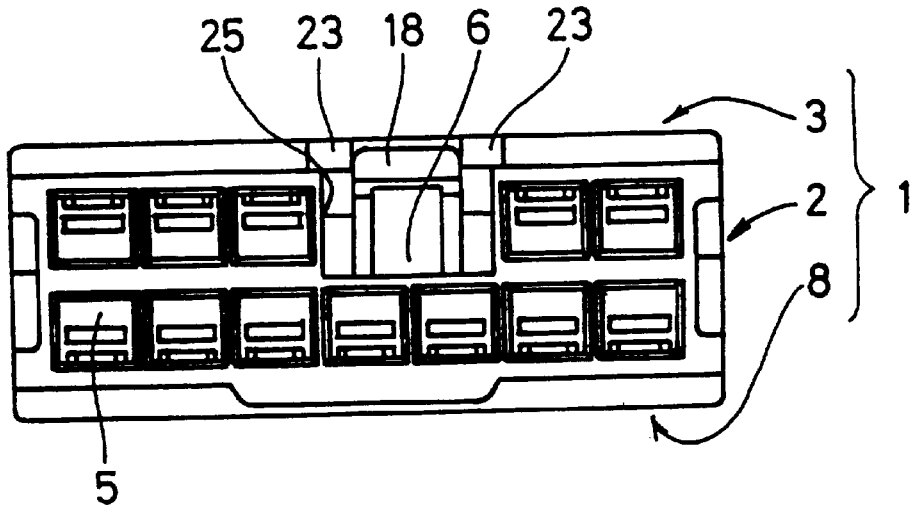
FIG. 4 is a rear view of the connector member of FIGS. 1 and 2.
Figure 5:
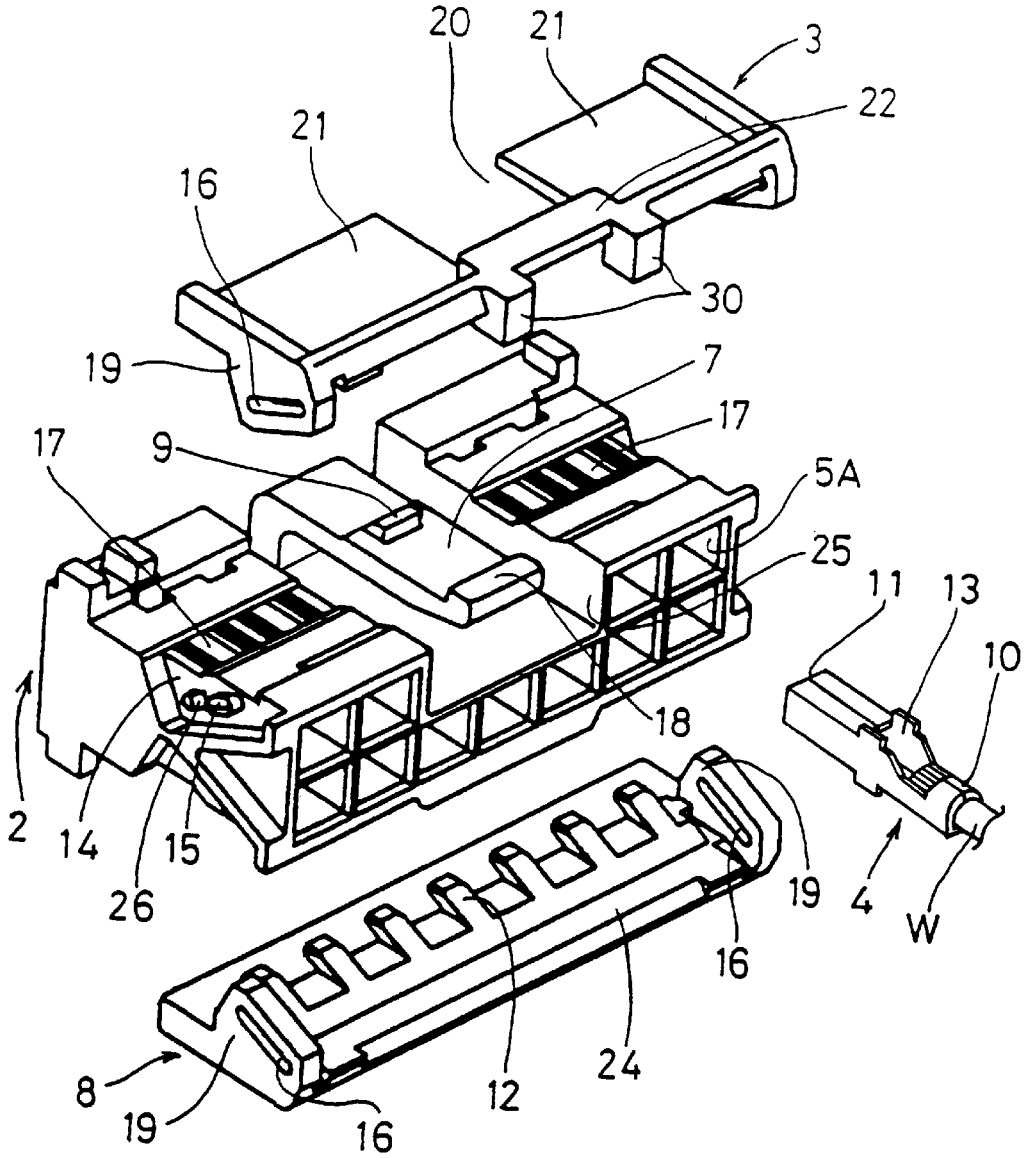
FIG. 5 is a perspective view of parts of a second connector member embodying the invention before the installation of the retainers on the connector housing body.
Figure 6:
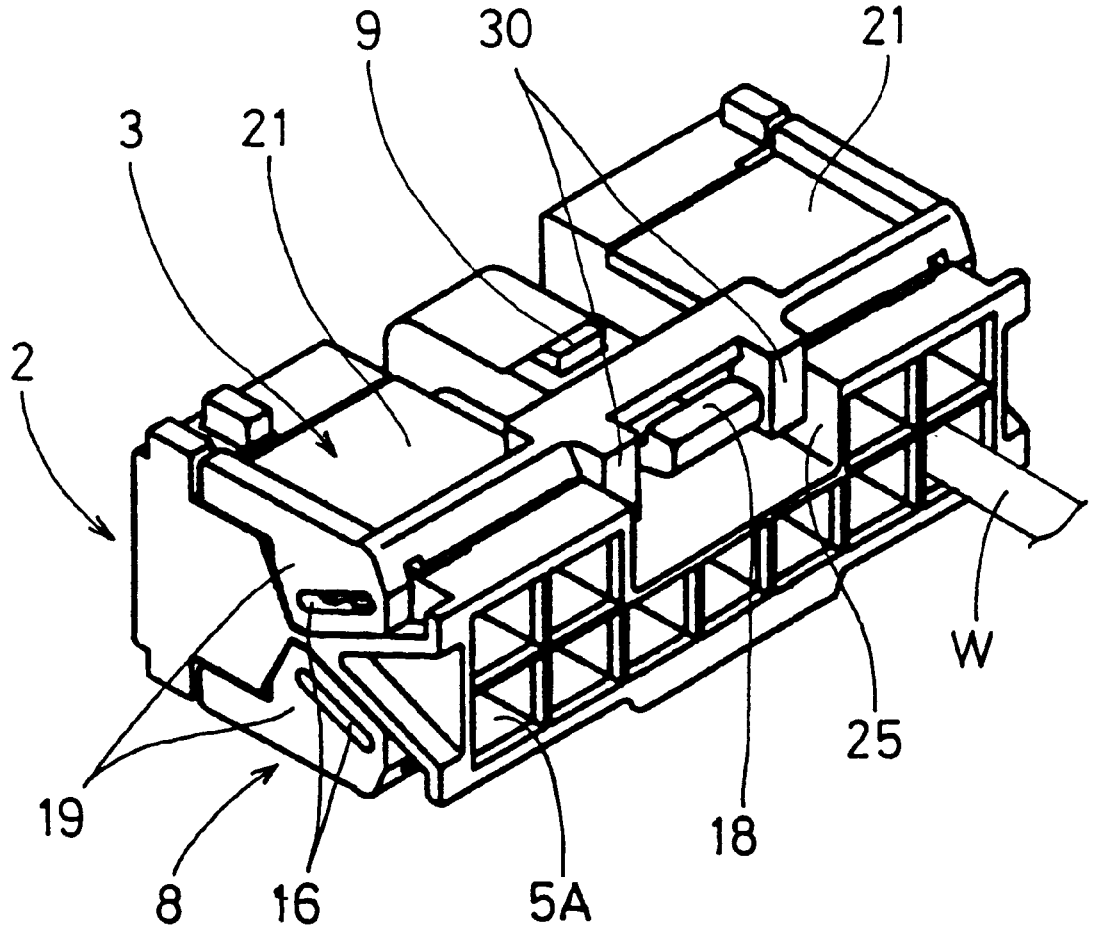
FIG. 6 is a perspective view of the connector member of FIG. 5 after the installation of the retainers on the connector housing body.
Figure 7:
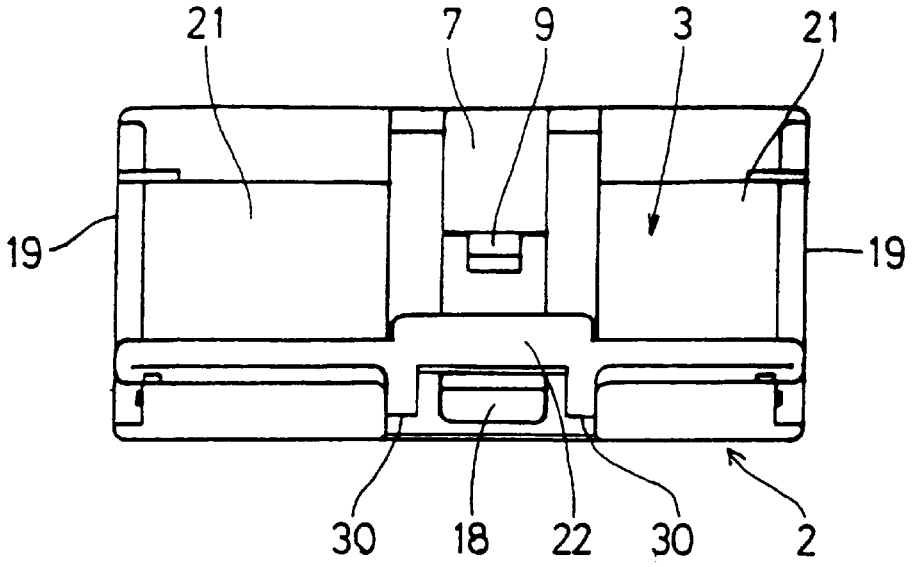
FIG. 7 is a plan view of the connector member of FIGS. 5 and 6.
Figure 8:
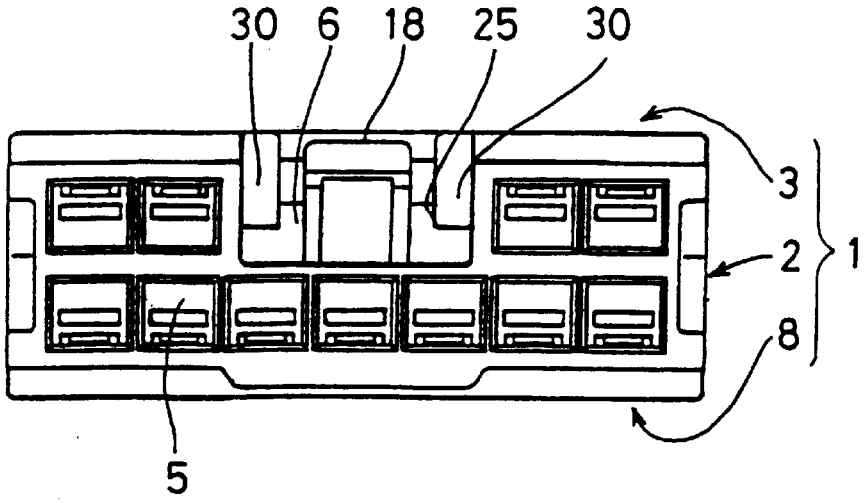
FIG. 8 is a rear view of the connector member of FIGS. 5 and 6.
Figure 9:
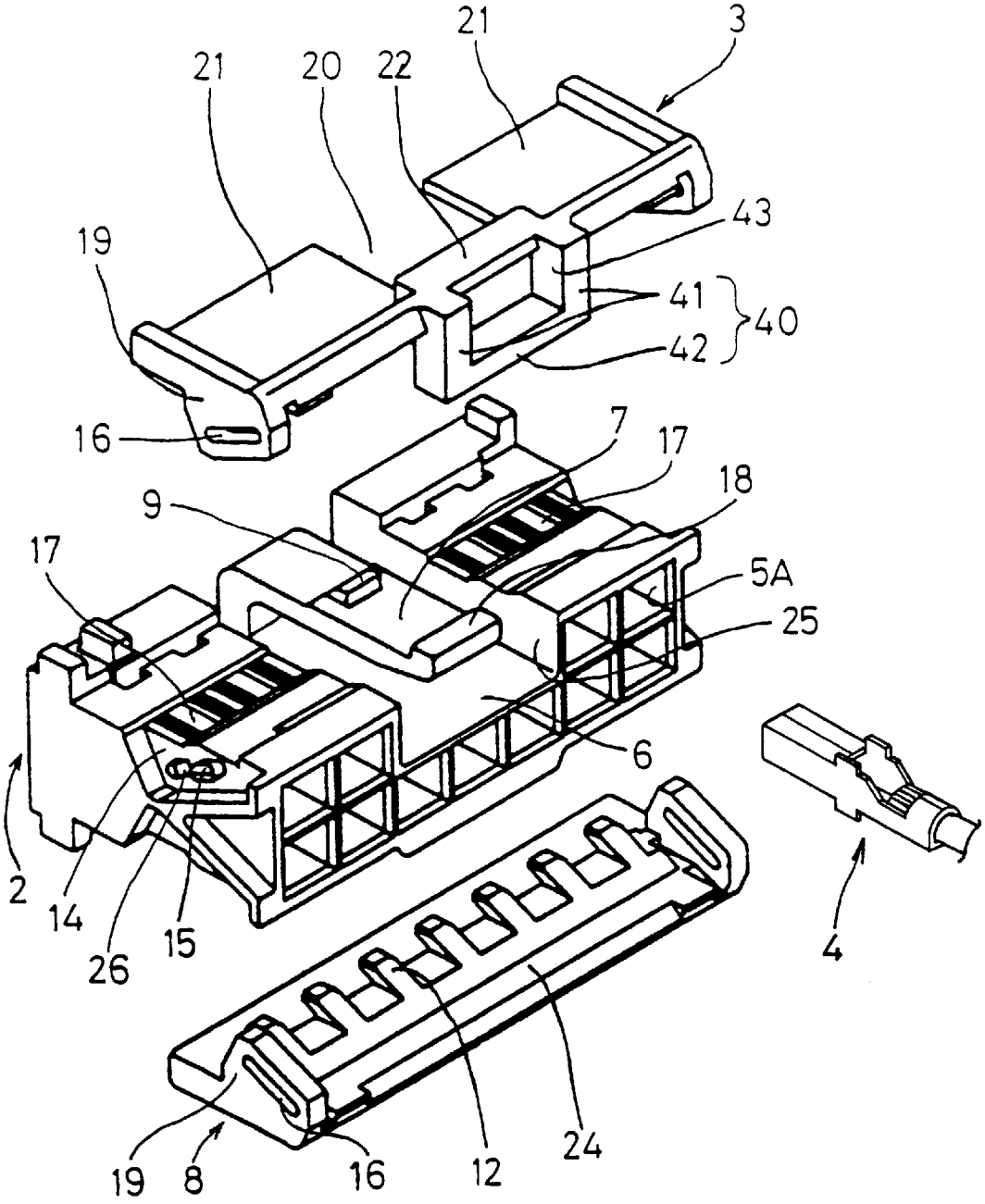
FIG. 9 is a perspective view of parts of a third connector member embodying the invention before the installation of the retainers on the connector housing body.
Figure 10:
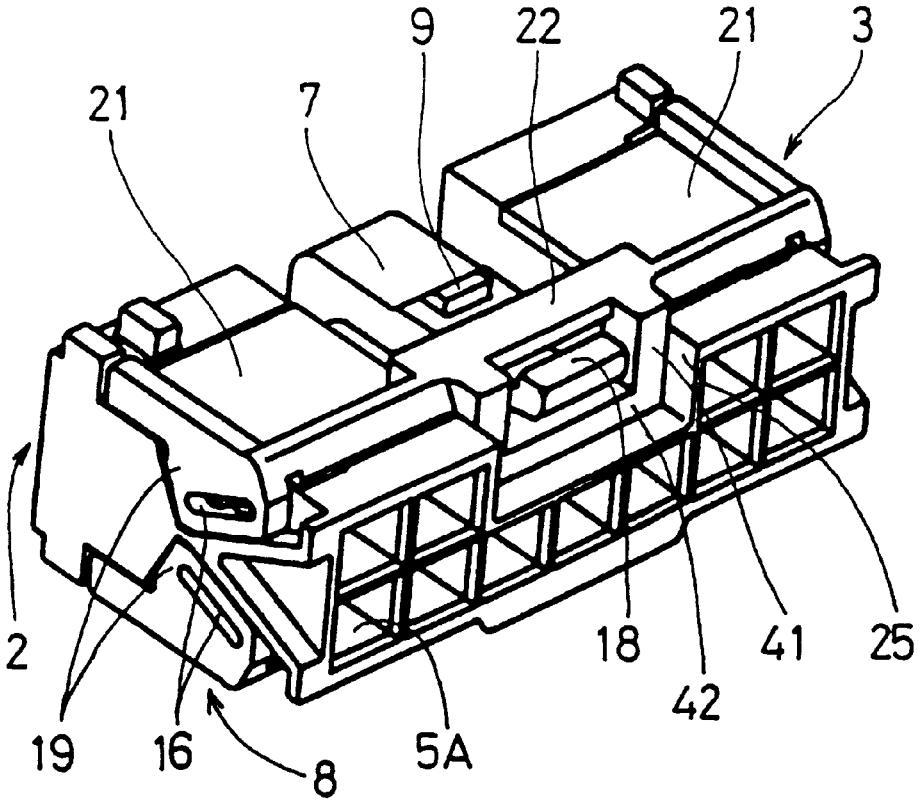
FIG. 10 is a perspective view of the connector member of FIG. 9 after the installation of the retainers on the connector housing body.
Figure 11:
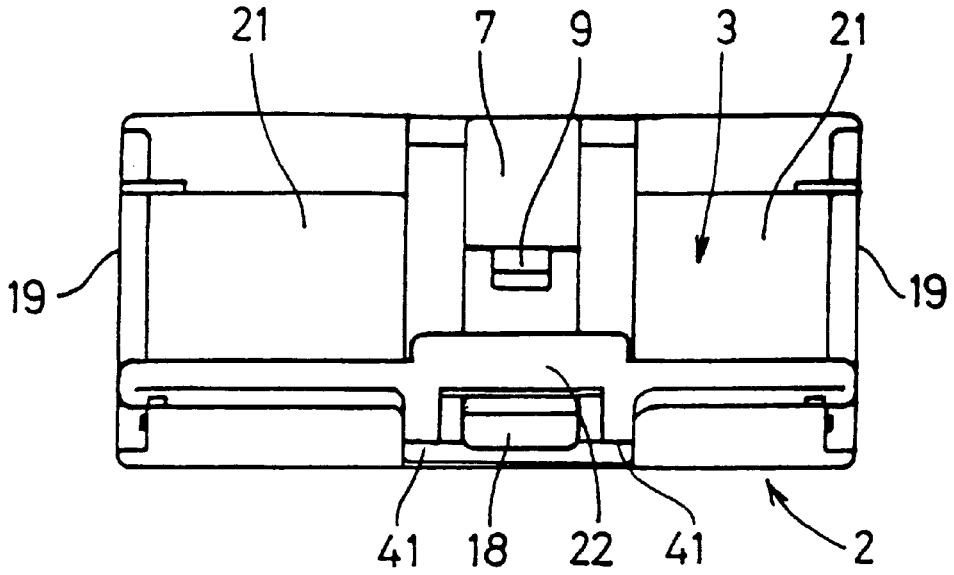
FIG. 11 is a plan view of the connector member of FIGS. 9 and 10.
Figure 12:
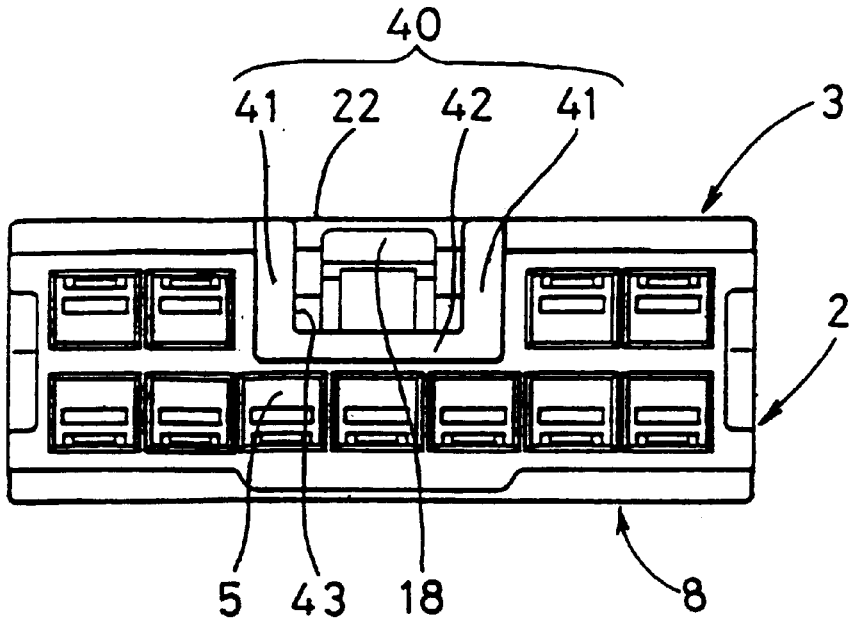
FIG. 12 is a rear view of the connector member of FIGS. 9 and 10.

One metal terminal 4 on a wire W is shown by way of example in FIG. 1. The terminals 4 are inserted into the passages 5 so that the wire W protrudes, as seen in FIG. 2. Resiliently deformable elements (not shown) which lock the terminals 4 in the passages in a latching manner are arranged on the inner wall faces of the passages 5 (i.e., wall faces which partition the passages at the top and the bottom) or on the terminals 4 themselves, in a known manner. Also in a known manner, there is a longitudinal rib (not shown) on a wall of each passage 5, which receives a groove or slot (also not shown) found on the terminal 4 so that the terminal may be inserted in the correct orientation. This prevents insertion of the terminal in an improper way. At the front ends of the passages 5 are the apertures (as seen in FIG. 4) through which opposing metal terminal fittings (not shown) are inserted, when the connector 1 is brought into engagement with a corresponding male connector (not shown).

As shown in FIG. 1, upper and lower faces of the connector housing body 2 have retainer holes 17 into which the respective terminal locking bars 12 of the retainers 3, 8 enter. The holes 17 are at the central part of the passages 5 in the longitudinal direction. When the retainers 3, 8 are at the normal locking position (shown in FIG. 2), the respective terminal locking bars 12 project into the passages 5 through the retainer holes 17, engage the respective terminals 4 and, acting in addition to the resiliently deformable elements mentioned above, retain the terminals in place against accidental withdrawal.

However, when the retainers 3, 8 are at the temporary position on the housing body 2 described below, the respective terminal locking bars 12 do not project into the passages 5 and permit the insertion and extraction of the terminals 4.

A recess 6 is open at the front and rear faces of the body 2 and is provided on the central part on the upper side of body 2. A locking arm 7 is arranged in the recess 6. The locking arm 7 extends rearwardly in a cantilever manner from its front end which is integral with the base of the recess 6. Gaps with nearly the same width are formed between the locking arm 7 and both side walls 25 of the recess 6. As described above, these gaps are necessary in order to receive a pair of walls on the receiving housing part (not illustrated) for guiding the mounting, for example, of the connector member 1 to the receiving housing part. These gaps also allow an operator's finger to depress the locking arm 7.

An upward projection 18 is formed at the rear end of the locking arm 7. The locking arm 7 is resiliently depressed by having an operator's finger press on the projection 18 so that the connector member 1 can be fitted to or separated from the receiving housing part. A second projection 9 is located at the center of the locking arm 7, and retains the connector member 1 in the receiving housing part by being received in a recess in the receiving housing. The rear end of the locking arm 7 is nearly in the plane of or slightly recessed from the rear face of the housing body 2.

The retainer holding recesses 14 at which the retainers 3, 8 are installed are located at both side faces of the housing body 2. Each retainer holding recess 14 has a triangular shape, and two protrusions 15, 26 project from its base wall. When only the temporary locking protrusion 15 is received in a slot 16 in the side walls 19 of the retainer 3, the retainer 3 is at the temporary locking position. On the other hand, when the upper retainer 3 is pushed slidingly along the recess 14, its flexible side walls 19 bend to allow the second locking protrusion 26 to enter the slot 16. When both the locking protrusions 15, 26 are received in the slot 16, the retainer 3 is at the normal (full) locking position, with its locking bars 12 engaging the terminals 4 as described above.

The terminals 4, which are installed in the passages 5, are each prepared by bending an electrically conductive steel plate at the rear end to form a barrel part 10 in which the wire W is fixed, and at the front end, the connecting parts 11 for connecting with the opposing male terminals. Further, an opening 13 into which the terminal locking bars 12 of the retainers 3, 8 are inserted, is arranged at a central part of the terminal 4.

The two retainers are the upper retainer 3, which is installed on the locking arm 7 side of the housing body 2, and the lower retainer 8, which is installed on the lower side which has no locking arm. The structure of the upper retainer 3 is described in detail using the same reference numerals given to corresponding parts of the lower retainer 8.

The upper retainer 3, integrally molded from a suitable synthetic resin, is installed on the upper face of the connector housing body 2 and locks the terminals 4. Where the upper retainer 3 extends over the locking arm 7, it has a U-shape slot 20 having the same width as the recess 6 of the housing body 2. The two side parts 21 are connected by a connecting piece 22 at the rear side to define the slot 20. Two gap blocking projections 23 protrude rearwardly on the rear side of the connecting piece 22.

When the upper retainer 3 is installed on the connector housing body 2 in its normal locking position, the connecting piece 22 is located just forward of the projection 18 and overlies the locking arm 7. The projections 23 are located on each side of the end part of the locking arm 7 at the gaps between the locking arm 7 and the side walls 25 of the recess 6 so as to overlie and thereby block these gaps. That is, the width of the projections 23 is equal to, or slightly greater than, the width of the gaps between the locking arm 7 and the side walls 25. When the upper retainer 3 is at the normal (full) locking position, the rear end positions of the projections 23 are nearly in the same vertical plane as the rear end of the locking arm 7, or are situated slightly in front of that plane. Also in this position, the discrepancy between the rear end of the locking arm 7 and the end of the projections 23 in the front to back direction is designed to be smaller than the diameter of the wire W, even in the case where the ends of the projections 23 are positioned forward of the rear end of the locking arm 7.

The terminal locking bars 12 corresponding to the passages 5 are located on the lower faces of the side parts 21 which face the connector housing body 2. From both sides of the upper retainer 3, the retainer side pieces 19, which project to overlap the sides of the connector housing body 2, are arranged to be resiliently deformable. The long slots 16 are located on the retainer side pieces 19.

Since there is no locking arm 7 on the lower side of the connector housing body 2, the lower retainer 8 is formed with a single sheet part 24. The terminal locking bars 12 are then arranged on the upper side of the lower retainer 8.

The operation of the connector member of FIGS. 1 to 4 is as follows. First, the retainers 3, 8 are put into the temporary position on the connector housing body 2. That is, the temporary locking protrusions 15 are placed in the slots 16 by bending the retainer side pieces 19.

Then, the metal terminals 4 are installed in the passages 5 of the connector housing body 2. The terminals 4 are locked first by the deformable projections (not shown) which are on the walls of the passages 5, or alternatively, on the terminals, as mentioned above.

Next the normal locking protrusions 26 are placed in the slots 16 by pressing the retainers 3, 8 towards the connector housing body 2 to reach the normal locking position. At this time, since the terminal locking bars 12 engage the openings 13 of the terminals 4 in the connector housing body 2, the terminals 4 are locked a second time.

Figure 3:
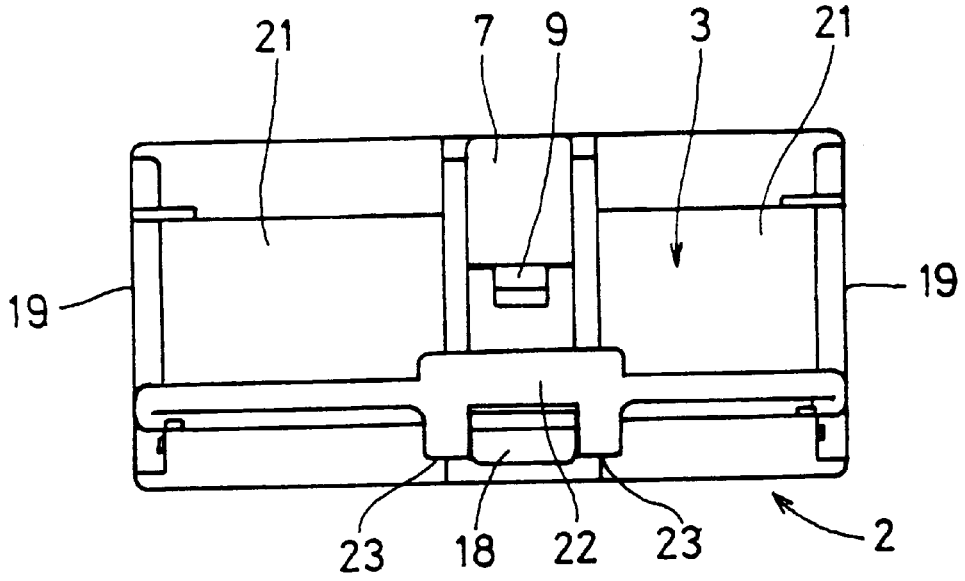
FIG. 3 is a plan view of the connector member of FIGS. 1 and 2.

Further, on the upper retainer 3, the projections 23 now block the gaps between the locking arm 7 and the side wall faces 25 of the recess 6, as seen in FIG. 3, for example. At the same time, when the upper retainer 3 is in the normal locking position, the edge positions of the projections 23 are nearly in the same plane with or situated slightly in front of the rear end of the locking arm 7. Since the size of the gaps are smaller than the diameter of the electrical wire W, the wire W cannot be placed into these gaps. As the gaps are also at least partially blocked when the upper retainer 3 is in the temporary locking position, the wire W cannot be easily placed into the gaps. Therefore, the risk of trapping foreign articles, such as a wire or the like, under the locking arm 7 can be reduced at both the normal and temporary locking positions, and accordingly, the permanent deformation or other problems caused by excessive lifting of the locking arm 7 by the wire W, can be avoided.

The second embodiment of the present invention is described with reference to FIGS. 5–8, in which the same reference numbers are used for parts corresponding to those of FIGS. 1–4. Detailed description of these parts is therefore omitted. In the second embodiment the gap blocking projections 30 at the rear edge of the retainer 3 protrude further downward as compared with the projections 23 in FIGS. 1–4. The projections 30 block the gaps between the locking arm 7 and the side wall faces 25 in a similar manner but are inserted in the gaps when the upper retainer 3 is installed on the connector housing body 2 (see FIG. 6 and FIG. 8). This structure also has the same function and effect as the first embodiment.

The third embodiment of the present invention is described with reference to FIGS. 9–12 in which the same reference numbers are used for parts corresponding to those of FIGS. 1–4. Detailed description of these parts is therefore omitted. In this embodiment the connector housing body 2 has the same structure as in the second embodiment. However, the projection 40 at the rear edge part of the upper retainer 3 is formed by a pair of opposing arms 41 which constitute gap-blocking portions and extend downward on opposite sides of the locking arm 7 from the connecting piece 22. Further, a connecting piece 42 connects the pair of arms 41 at their lower ends. The locking arm 7 can be inserted in the aperture 43 which is surrounded by the four parts 22, 41, 41 and 42. However, when the connecting piece 42 is at the normal locking position, the operation of the locking arm 7 is not obstructed.

This structure improves the strength of the central part of the upper retainer 3, as the arms 41 are mutually connected by the connecting piece 42. Therefore, bending and deformation of the upper retainer 3 are effectively prevented. Such effects are particularly effective when the upper retainer 3 is required to be long in order to handle a connector with multiple poles.

The present invention is not limited by the embodiments described and encompasses all embodiments within the spirit and scope of the invention as herein described. A connector equipped with a pair of retainers has been illustrated, but a connector having one retainer may be used and the retainer need not be a separate body from the connector housing body, for example. The retainer may be in an integrated relationship with the connector housing body to which it is connected by hinges or the like.

What is claimed is:

1. A connector member for use in connecting electrical wiring, comprising:

a housing body having a rear end and a front end and a first face extending from the rear end to the front end and a plurality of passages for receiving metal wiring terminals, the passages extending from said rear end towards said front end;

a recess in said first face having opposing side walls;

a resilient locking arm having a first end mounted on said housing body, an arm portion extending from said first end and a head portion which is remote from said first end and projects above said arm portion in a direction away from a base of the recess, said locking arm being adapted to engage and lock with another connector part, and said locking arm being at least partly located in said recess between said opposing side walls thereof, with gaps formed between said head portion and said side walls; and a terminal retainer mounted on said housing body so as to extend across said first face thereof, the terminal retainer located on said housing body in a locking position in which it locks in place any said metal terminals which have been inserted in said passages of said housing body, wherein said terminal retainer has, at its rearward end, a pair of gap blocking portions which, at least in said locking position thereof, lie on opposite sides of said head portion of said locking arm so as to at least partially block said gaps between said head portion of said locking arm and said side walls of said recess.

2. The connector member according to claim 1, wherein said terminal retainer has a bridge portion overlying said locking arm in said locking position, said gap blocking portions extending rearward from said bridge portion so as to overlie said gaps between said head portion of said locking arm and said side walls of said recess, thereby blocking said gaps.

3. The connector member according to claim 1, wherein in said locking position of said terminal retainer, said gap blocking portions thereof are located in said gaps between said head portion of said locking arm and said side walls of said recess.

4. The connector member according to claim 3, wherein said terminal retainer has a connection portion having opposite ends respectively joining said pair of gap blocking portions, said connector portion underlying said locking arm.

5. The connector member according to claim 1, wherein wires are held in said metal wiring terminals, and a discrepancy between a rearward-most end of said resilient locking arm and rearward-most ends of said gap blocking portions is smaller than a diameter of said wires.

6. A connector member for use in connecting electrical wiring, comprising:

a housing body having a rear end, a front end, a first face extending from the rear end to the front end, and a plurality of passages for receiving metal wiring terminals, the passages extending from said rear end toward said front end;

a recess in said first face having opposing side walls;

a resilient locking arm having a first end mounted on said housing body, an arm portion extending from said first end, and a head portion which is remote from said first end and projects above said arm portion in a direction away from a base of the recess, said locking arm being at least partly located in said recess between said opposing side walls, with gaps formed between said head portion and said side walls; and a terminal retainer mounted on said housing body and extending across said first face, the terminal retainer being movable on said housing body to a locking position in which the terminal retainer locks in place any said metal terminals which have been inserted in said passages of said housing body, said terminal retainer having a rearward end that faces in a same direction as said rear end of said housing body, said rearward end of said terminal retainer having a pair of gap blocking portions which, at least when said terminal retainer is located in said locking position, lie on opposite sides of said head portion of said locking arm in said gaps so as to at least partially block said gaps, said pair of gap blocking portions having rearwardmost ends that are located proximate to a rearwardmost end of said head portion, in the rearward direction.

7. The connector member according to claim 6, wherein in said locking position of said terminal retainer, said gap blocking portions are located in said gaps between said head portion of said locking arm and said side walls of said recess.

8. The connector member according to claim 7, wherein said terminal retainer has a connection portion having opposite ends respectively joining said pair of gap blocking portions, said connector portion underlying said locking arm.

* * * * *